United States Patent [19]

Schar

[11] 4,023,741

[45] May 17, 1977

[54] APPARATUS FOR WINDING A MULTIPLICITY OF THREADS ONTO RESPECTIVE BOBBIN TUBES

[75] Inventor: Hugo Schär, Dattlikon, Switzerland

[73] Assignee: Rieter Machine Works, Ltd., Winterthur, Switzerland

[22] Filed: Nov. 12, 1975

[21] Appl. No.: 630,945

[30] Foreign Application Priority Data

Nov. 15, 1974 Switzerland ..... 15235/74

[52] U.S. Cl. ..... 242/18 R; 242/18 PW; 242/19; 242/35.5 R; 242/41

[51] Int. Cl.[2] ..... B65H 54/02; B65H 67/04

[58] Field of Search ..... 242/18 A, 18 PW, 18 G, 242/18 EW, 18 R, 35.5 R

[56] References Cited

UNITED STATES PATENTS

| | | | |
|---|---|---|---|
| 3,166,262 | 1/1965 | Vanneman, Sr. | 242/18 PW |
| 3,814,341 | 6/1974 | Dickson et al. | 242/18 PW |

*Primary Examiner*—George F. Mautz
*Attorney, Agent, or Firm*—Kenyon & Kenyon Reilly Carr & Chapin

[57] ABSTRACT

Two bobbin tubes are mounted on a common bobbin chuck and a common thread severing means and suction means is used to sever and hold the threads during a bobbin change. After the threads are severed and drawn into the suction tube, a rod which carries two thread holders and the suction tube are pivoted into the thread path and around the fresh empty bobbin tubes on the chuck. A second pair of thread holders guide the threads during this time. After re-threading on the bobbin tubes, the rod and suction tube are returned to their initial positions to place the threads into respective reserve winding devices and thread guides.

7 Claims, 3 Drawing Figures

12
15'
17'
14'
15
13
16
17
18
5
9
14
B
10
8
4
11
7'
7
S
3
2'
2
6'
1
S'
6

APPARATUS FOR WINDING A MULTIPLICITY OF THREADS ONTO RESPECTIVE BOBBIN TUBES

BACKGROUND OF THE INVENTION

This invention relates to an apparatus for winding a multiplicity of threads onto respective bobbin tubes. More particularly, this invention relates to an apparatus on a winding machine for separating and threading up two threads supplied continuously at high speed towards two bobbin tubes.

Multiple-bobbin tube winders have been known, such as described in U.S. Pat. No. 3,880,371, wherein two thread packages are formed simultaneously on two bobbin tubes placed onto a common bobbin chuck, their face sides being adjacent. In order to perform a bobbin change with such a device, the threads are first severed and are inserted into a suction device held in the hand of an operator. Subsequently, the full bobbins are exchanged for empty bobbin tubes. In order to thread the two threads onto the empty bobbin tubes, the threads are threaded manually, using the suction device, into which the threads have been sucked during the bobbin change, through a slot-shaped thread guide in a downward direction and into contact with the two empty bobbin tubes and are taken up together by the bobbin tubes in the zone where the tubes are joined. The zone where the bobbin tubes are joined is provided with a circumferential recess for taking up the waste windings. After the threads are taken up in the recess, and after a number of waste windings are formed, the threads are released by retracting the slot-shaped thread guide. Due to the thread tension components directed towards the respective bobbin tube centers, the threads move towards the right and left of the recess to the respective winding zones, a few spiral windings being placed onto the bobbin tube.

However, this known device has disadvantages which preclude the use of automatic bobbin change devices (doffers). One of these disadvantages resides in the need for a manual severing of the incoming threads before sucking them off, as well as in the subsequent manual threading of the threads into the thread guide and placement into a common circumferential groove on the bobbin tubes. The threading in process of the two threads at the middle of both tubes also results in the production of two different bobbin packages, namely, a left hand one and a right hand one. Differing bobbin packages, however, are not desirable in further processing.

Accordingly, it is an objective of the invention to create a reliable and simple device requiring a minimum of suction air for separating and threading-in threads in changing the bobbin packages on a double winding position.

It is another object of the invention to provide an apparatus which can be used with automatic bobbin change devices to wind a plurality of threads onto separate bobbin tubes.

It is another object of the invention to reduce the air consumption required for holding severed thread ends in a multiple-bobbin tube winder.

It is another object of the invention to wind bobbin packages of the same type on a multiple-bobbin tube winder.

It is another object of the invention to provide a multiple-bobbin tube winder which can be operated at least semi-automatically with a minimum of manual labor.

Briefly, the invention provides an apparatus for winding a multiplicity of threads onto respective bobbin tubes. The apparatus includes a common bobbin chuck for receiving a multiplicity of bobbin tubes for example two, a common package drive for driving the chuck, a movable thread severing means to sever the threads supplied to the bobbin tubes and a movable common thread suction means for moving with the severing means to draw in the severed ends of the threads. In addition, the apparatus includes a plurality of pairs of thread holders with each pair being positioned at a respective bobbin tube. One holder of each pair is movable from a first position located out of the path of a respective thread to a second position to move the respective thread into the other holder of the pair and onto a respective bobbin tube.

The apparatus also includes a plurality of thread transversing guides, each of which is positioned adjacent a respective bobbin tube as well as a plurality of reserve winding devices, each of which is positioned adjacent a respective bobbin tube. The movable thread holder upon moving back to the initial position, allows each thread to move into a respective reserve winding device and traversing guide.

The severing means may be in the form of a knife while the suction means is in the form of a tube on which the knife is mounted. In this arrangement, both the knife and tube move in parallel relation with the bobbin chuck to sever and draw on the threads at the start of a bobbin change.

These and other objects and advantages of the invention will become more apparent from the following detailed description and accompanying drawings in which.

Figure 1:
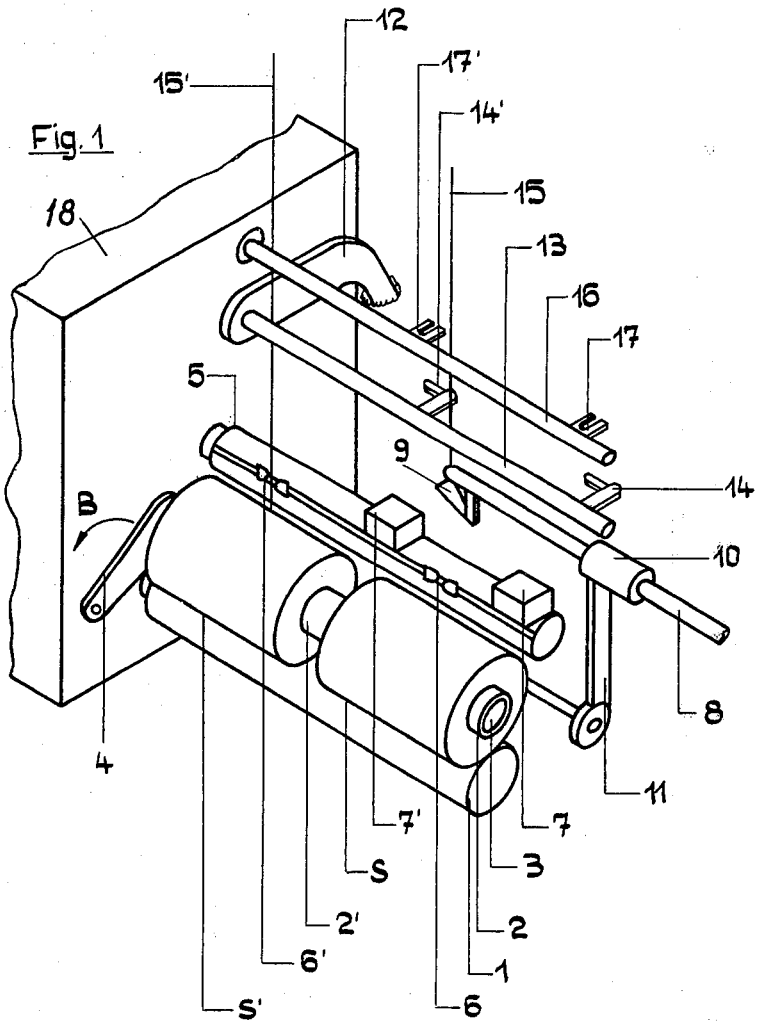
FIG. 1 illustrates a winding device with a double winding position according to the invention shown schematically in an axonometric view.

Referring to FIG. 1, the apparatus for winding a multiplicity of threads, e.g., two, includes a machine frame 18 on which various components are mounted. These components include a friction drive drum 1 which contactingly drives a pair of bobbin tubes 2 and 2' respectively or a pair of bobbin packages S and S', respectively. The bobbin tubes 2 and 2' are placed on a common rotatable bobbin chuck 3 which, as the bobbin packages S, S' are built up, pivots in the direction of the arrow B via an arm 4 which mounts the chuck 3 on the frame. A thread traversing device 5 is mounted on the frame 18 to serve as a mount for two thread guides 6, 6' and two thread reserve winding devices 7, 7' known as such for generating a thread reserve.

A movable thread servering means 9 is mounted on the frame 18 along with a movable common thread suction means 8. To this end, the suction means 8 is in the form of a tube which is slidably mounted in a sleeve 10 of a pivoting arm 11 pivoted to the frame 18. The tube 8 is disposed to move parallel to the bobbin chuck axis. Alternatively, the suction tube 8 can be a fixed part of the arm 11 or can be introduced into the sleeve 10 for a bobbin change operation. The severing means 9 is in the form of a knife mounted at the end of the suction tube 8.

A plurality of pairs of thread holders are also mounted on the frame 18. To this end, an arm 12 is pivotally mounted on the frame 18 and carries a rod 13 which extends from the frame 18 in parallel to the bobbin chuck 3. This rod 13 mounts two thread holders 14, 14' of L-shaped which serve to guide two threads 15, 15' which are spun in and supplied from spinnerets in known manner. In addition, a rod 16 extends from the frame 18 above the rod 13 and carries two thread holders 17, 17' of bifurcated shape. As shown, the thread holders are arranged vertically in pairs relative to each thread 15, 15' and are adjacent a respective bobbin tube, S, S'.

The rod 13 carrying the thread holders 14, 14' is pivoted from a first position (FIG. 2) located out of the path or thread traversing zone of the threads 15, 15' to a second position (FIG. 3) to move the threads 15, 15' into the holders 17, 17' and onto the tubes S, S'. The rod 13 is also pivoted back to the first position in order to allow the threads 15, 15' to move into a respective reverse winding device 7, 7' and yarn guide 6, 6'. The suction tube 8 is pivoted at the same time but is initially located, as is the knife 9, in the same plane as the threads 15, 15'.

Figure 2:
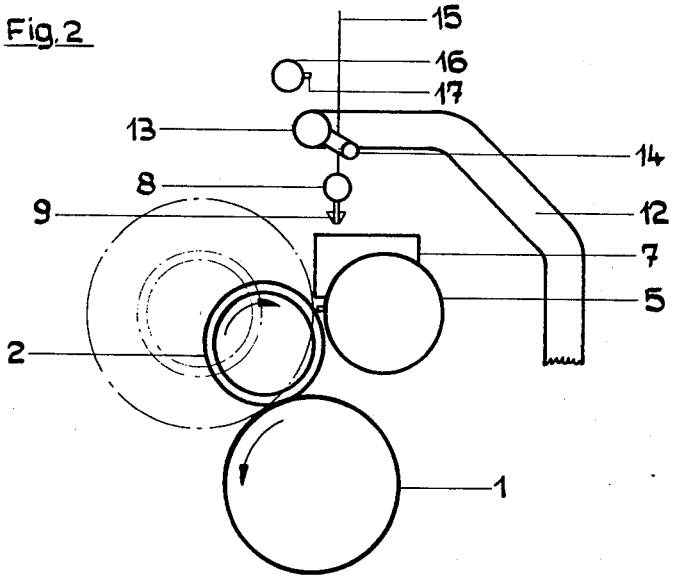
FIG. 2 illustrates a schematic view of the thread path before a bobbin change.

In FIG. 2, the thread path and the positions of the machine parts before (dash-dotted lines) and after (solid lines) the donning of new bobbin tubes are shown. The incoming threads 15, 15', pass through the bifurcated thread holders 14, 14' and are sucked into the suction tube 8 together.

Figure 3:
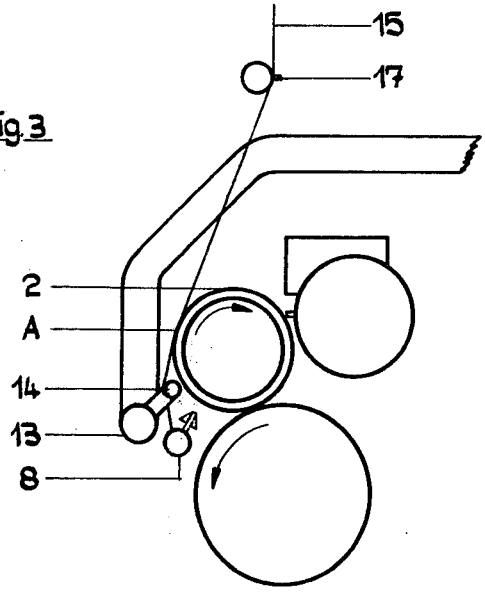
FIG. 3 illustrates a schematic view of the thread path during the threading up of the threads on the fresh empty tubes.

In FIG. 3, the thread path and the positions of the machine parts are shown in the moment of the threading in of the threads 15, 15'; rod 13 and suction tube 8 having been pivoted. The thread paths between the thread holders 17, 17' and the thread holders 14, 14' are deflected at the point A by the tubes 2, 2'.

Severing and threading in of the delivered threads, is effected continuously as follows: As the bobbin packages S, S' built upon the bobbin tubes 2, 2' reach the size desired, the suction tube 8 is moved by the operator or by a drive mechanism (not shown) from outside the thread traversing zone in the direction towards the machine frame 18 by sliding in the sleeve 10. As the suction tube 8 and the knife 9 are arranged in the same plane as the threads 15, 15', the thread 15 is severed first as the suction tube 8 including the knife 9 is moved forward and the end of the thread 15, which continues to be supplied, is sucked in by the suction tube 8 (FIG. 1). Subsequently, the second thread 15' is severed and similarly drawn into the tube 8. Next, the suction tube 8, with the drawn in threads 15, 15', is brought back to its starting position outside the traversing zone. As the suction tube 8 is moved back, the thread 15' is caught by the thread holder 14' and the thread 15 is caught by the thread holder 14. The two threads 15, 15' now extend from the spinneret (not shown) to the holding rod 13 substantially in parallel to each other and in planes extending at right angles to the rod 16 behind the two thread holders 17, 17' respectively.

After severing the threads 15, 15', the two bobbin packages S, S' are pivoted away from the friction drive drum 1, are braked and are exchanged for empty bobbin tubes 2, 2'. The bobbin change process in this arrangement can be effected manually or automatically by a bobbin exchange device.

Upon pivoting the bobbin chuck 3 back onto the friction drive drum 1, the empty bobbin tubes 2, 2' are accelerated to the operational rotating speed. Now, the suction tube 8 and the holding rod 13 are pivoted simultaneously from their starting position (FIG. 2) into a threading-up position (FIG. 3). Shortly after the beginning of the pivoting movement, the threads 15, 15' are brought into the reach of the thread holders 17, 17' by the holders 14, 14'. The threading-up position is reached when the incoming threads 15, 15' are deflected around the thread holders 17, 17' and the bobbin tubes 2, 2', i.e. when the threads 15, 15' contact the bobbin tubes 2 and 2'. The bobbin tubes 2, 2' are provided with adhesive zones at their circumference in the zone of the contact A of the threads to wind on the threads. Because of the sudden reversal of the direction of the thread path, the threads which are drawn into the suction tube are then broken in the region of the suction tube. Subsequently, the suction tube 8 and the rod 13 are brought back into their starting positions in such a manner that the threads 15, 15' are placed into the thread reserve winding devices 7, 7' for forming thread reserves that is, as the bobbin tubes 2, 2' continue to rotate in a clockwise direction as viewed in FIG. 1 with the threads grasped thereon, the threads are each moved into the reserve winding devices 7, 7' and are then guided in known manner, to form yarn reserve. Thereafter, the threads slide into the traversing thread guides 6, 6' and the bobbin package build begins.

The invention thus provides an apparatus which is useful in cooperation with automatic bobbin change devices. Further, the apparatus has a very low air consumption since only one suction nozzle is provided for each double winding position. Since both threads are threaded up simultaneously but separately onto the zones on the bobbin tubes provided for this purpose, identically wound bobbin packages are generated. Also, no waste windings are covered beneath the bobbin packages which could prove disadvantageous in further processing steps.

What is claimed is:

1. An apparatus for winding a multiplicity of threads onto respective bobbin tubes, said apparatus comprising:

a common bobbin chuck for receiving a multiplicity of bobbin tubes thereon;

a bobbin package drive for driving said chuck with the bobbin tubes thereon;

a plurality of thread traversing guides, each guide being positioned adjacent a respective bobbin tube on said bobbin chuck;

a plurality of thread reserve winding devices, each said device being positioned adjacent a respective bobbin tube on said bobbin chuck;

a movable thread severing means for moving relative to said bobbin chuck to sever the threads supplied to the bobbin tubes on said bobbin chuck;

a movable common thread suction means for moving with said severing means to draw on the ends of several threads;

a plurality of pairs of thread holders, each said pair of thread holders being positioned at a respective bobbin tube on said bobbin chuck, one of said holders of each said pair of holders being movable from a first position located out of the path of a respective thread to a second position to move the respective threads into the other of said pair of holders and onto a respective bobbin tube on said chuck, and back to said first position while allowing each thread to move into a respective reserve winding device and into a respective traversing guide.

2. An apparatus as set forth in claim 1 wherein said severing means is a knife and said suction means is a suction tube mounting said knife thereon.

3. An apparatus as set forth in claim 1 wherein said severing means and said suction means are movable in parallel relation to said bobbin chuck.

4. In an apparatus for winding two threads onto two bobbin tubes, the combination comprising:

a bobbin chuck for receiving the bobbin tubes;

a drive for driving said bobbin chuck;

a movable thread severing means for moving relative to said bobbin chuck to sever threads supplied to the bobbin tubes on said bobbin chuck;

a movable thread suction means for moving with said severing means to draw in the ends of several threads; and two pairs of thread holders, each said pair of thread holders being positioned at a respective bobbin tube on said bobbin chuck, one of said holders of each said pair of holders from a first position located out of the path of a respective thread to a second position to move the respective thread into the other of said pair of holders and onto a respective bobbin tube on said chuck.

5. In an apparatus as set forth in claim 4, frame mounting said chuck, said drive, said severing means and said pairs of thread holders thereon.

6. An apparatus for winding two threads onto two bobbin tubes, said apparatus comprising:

a machine frame;

a bobbin chuck rotatably mounted on said frame;

a bobbin package drive mounted on said frame for rotating said chuck;

a thread traversing means mounted on said frame and including a pair of thread guides each positioned adjacent a respective bobbin tube on said chuck;

a pair of thread winding devices mounted on said traversing means adjacent a respective bobbin tube on said chuck;

a thread holding means mounted on said frame and having a pair of first thread holders thereon adjacent a respective bobbin tube on said chuck;

a rod having a pair of second thread holders thereon between said first thread holder and said bobbin chuck;

a common severing device mounted on said frame for moving relative to said chuck to sever threads extending to the bobbin tubes on said chuck;

a common suction device mounted on said frame for moving with said severing device to draw in the ends of severed threads and to hold the threads against the respective pair of second holders; and means mounted on said frame for pivoting said rod from a first position located out of the path of the severed threads to a second position to move the respective threads into the pair of first holders and onto a respective bobbin tube on said chuck and then back to said first position while allowing each thread to move into a respective reserve winding device and thread guide.

7. An apparatus as set forth in claim 6 which further comprises means for moving said suction device about said chuck with said rod.

* * * * *